US006478147B1

(12) United States Patent
Brander et al.

(10) Patent No.: US 6,478,147 B1
(45) Date of Patent: Nov. 12, 2002

(54) CONTAINER WITH ABSORBENT MATERIAL

(76) Inventors: William M. Brander, 8536 Bowden St., Douglasville, GA (US) 30134; Richard E. d'Ablaing, 225 LaGrange St., Newnan, GA (US) 30263; Thomas P. Gautreaux, 6660 Yates Way, Riverdale, GA (US) 30274

( * ) Notice: Subject to any disclaimer, the term of this patent is extended or adjusted under 35 U.S.C. 154(b) by 0 days.

(21) Appl. No.: 09/722,773

(22) Filed: Nov. 27, 2000

Related U.S. Application Data

(63) Continuation-in-part of application No. 09/105,349, filed on Jun. 29, 1998, now Pat. No. 6,152,295.

(60) Provisional application No. 60/079,550, filed on Mar. 27, 1998, and provisional application No. 60/086,854, filed on May 27, 1998.

(51) Int. Cl.[7] ..... B65D 81/26; B65D 1/36

(52) U.S. Cl. ..... 206/204; 426/124; 426/394; 426/396

(58) Field of Search ..... 426/115, 124, 426/383, 394, 396; 206/204; 229/406, 407

(56) References Cited

U.S. PATENT DOCUMENTS

| | | | | |
|---|---|---|---|---|
| 3,066,847 | A | | 12/1962 | Fortune |
| 3,156,402 | A | | 11/1964 | Dupuis et al. |
| 3,559,416 | A | | 2/1971 | Cornwall |
| 3,670,731 | A | | 6/1972 | Harmon |
| 3,834,606 | A | | 9/1974 | Andersson |
| 3,881,489 | A | | 5/1975 | Hartwell |
| 3,935,363 | A | | 1/1976 | Burkholder et al. |
| 3,965,906 | A | | 6/1976 | Karami |
| 3,981,100 | A | | 9/1976 | Weaver et al. |
| 3,989,867 | A | | 11/1976 | Sisson |
| 3,990,872 | A | | 11/1976 | Cullen |
| 3,993,553 | A | | 11/1976 | Assarsson et al. |
| 3,999,653 | A | | 12/1976 | Haigh et al. |
| 4,055,180 | A | | 10/1977 | Karami |
| 4,089,982 | A | * | 5/1978 | Miyahara ..... 426/394 |
| 4,181,285 | A | | 1/1980 | Vangedal-Nielsen |
| 4,252,269 | A | | 2/1981 | Peppiatt |
| 4,275,811 | A | | 6/1981 | Miller |
| 4,321,997 | A | | 3/1982 | Miller |
| 4,382,507 | A | | 5/1983 | Miller |
| 4,404,820 | A | | 9/1983 | Romaine |
| 4,410,578 | A | | 10/1983 | Miller |
| 4,442,969 | A | | 4/1984 | Holden |
| 4,454,055 | A | | 6/1984 | Richman et al. |
| 4,487,791 | A | | 12/1984 | Komatsu et al. |
| 4,528,228 | A | * | 7/1985 | Clevenger ..... 426/124 |
| 4,550,439 | A | | 10/1985 | Peppiatt et al. |
| 4,552,600 | A | | 11/1985 | Laiewski et al. |
| 4,573,203 | A | | 2/1986 | Peppiatt |
| 4,573,578 | A | | 3/1986 | Greminger, Jr. et al. |
| 4,576,278 | A | | 3/1986 | Laiewski et al. |
| 4,596,250 | A | | 6/1986 | Beisang, III et al. |
| 4,615,923 | A | | 10/1986 | Marx |
| 4,619,361 | A | | 10/1986 | Thomas, Jr. et al. |

(List continued on next page.)

FOREIGN PATENT DOCUMENTS

| | | |
|---|---|---|
| DE | 40 39 354 A | 6/1992 |
| DE | 42 34 632 A1 | 4/1994 |
| FR | 2402599 | 4/1979 |
| JP | 406080164 A | 3/1994 |

*Primary Examiner*—Bryon P. Gehman
(74) *Attorney, Agent, or Firm*—Thomas, Kayden, Horstemeyer & Risley

(57) ABSTRACT

A preferred storage container includes a base that defines an interior, and a lid that defines a reservoir. The lid is configured to engage the base so that food products placed within the interior may be retained therein. An absorbent material is arranged within the reservoir of the lid and is retained therein by a cover formed of liquid permeable material. The cover permits liquid exuded from the food products to enter the reservoir so that the absorbent material may absorb the liquid, such as when the storage container is inverted. Methods also are provided.

19 Claims, 7 Drawing Sheets

U.S. PATENT DOCUMENTS 4,702,377 A 10/1987 Grone
4,713,839 A 12/1987 Peppiatt
4,742,908 A 5/1988 Thomas, Jr. et al.
4,780,117 A 10/1988 Lahey et al
4,815,590 A 3/1989 Peppiatt et al.
4,573,203 A 4/1989 Peppiatt
4,856,651 A 8/1989 Francis, Jr. et al.
4,861,632 A 8/1989 Caggiano
4,877,336 A 10/1989 Peppiatt
4,898,273 A 2/1990 Kristiansen
4,914,066 A 4/1990 Woodrum
4,927,010 A 5/1990 Kannankeril
4,929,480 A 5/1990 Midkiff et al.
4,940,621 A 7/1990 Rhodes et al.
4,949,897 A 8/1990 Pawiak et al.
4,984,907 A 1/1991 Power
4,984,908 A 1/1991 Kronenberger et al.
4,995,217 A 2/1991 Francis, Jr.
4,998,671 A 3/1991 Leifheit
5,022,945 A 6/1991 Rhodes et al.
5,031,418 A 7/1991 Hirayama et al.
5,033,867 A 7/1991 Peppiatt
5,033,868 A 7/1991 Peppiatt
5,035,241 A 7/1991 Walasek et al.
5,054,290 A 10/1991 Hogan
5,055,332 A 10/1991 Rhodes et al.
5,080,497 A 1/1992 Peppiatt
5,112,138 A 5/1992 Peppiatt
5,135,787 A 8/1992 Bair
5,148,613 A * 9/1992 Cullen ..... 206/204
5,150,707 A 9/1992 Anderson
5,160,308 A 11/1992 Peppiatt
5,174,657 A 12/1992 Peppiatt
5,176,930 A 1/1993 Kannankeril et al.
5,221,143 A 6/1993 Peppiatt
5,263,479 A 11/1993 Tesch
5,265,401 A 11/1993 Gujer et al.
5,271,244 A 12/1993 Staggs
5,346,312 A 9/1994 Mabry et al.
5,356,678 A 10/1994 Heitzhaus et al.
5,361,465 A 11/1994 O'Donnell
5,366,791 A 11/1994 Carr et al.
5,372,429 A 12/1994 Beaver, Jr. et al.
5,393,462 A 2/1995 Avery
5,417,276 A 5/1995 Dobry
5,447,532 A 9/1995 Furuya
5,552,169 A 9/1996 Kannankeril et al.
5,660,868 A 8/1997 Yeager
5,709,089 A 1/1998 Dawson et al.
5,709,897 A 1/1998 Pearlstein
5,720,999 A 2/1998 Lanzani et al.
5,813,564 A * 9/1998 Luo ..... 206/204
5,839,572 A 11/1998 Yeager
5,845,769 A 12/1998 Yeager
5,988,050 A * 11/1999 Foster, Jr. ..... 426/124

* cited by examiner

CONTAINER WITH ABSORBENT MATERIAL

CROSS REFERENCE TO RELATED APPLICATIONS

This application is a Continuation-In-Part Application, which is based on and claims priority to U.S. Utility application, Ser. No. 09/105,349, filed on Jun. 26, 1998, now U.S. Pat. No. 6,152,295, which is based on and claims priority to U.S. Provisional Applications, Ser. Nos. 60/079,550, filed on Mar. 27, 1998, and 60/086,854, filed on May 27, 1998.

BACKGROUND OF THE INVENTION

1. Field of the Invention

The present invention generally relates to storage containers for storing foods and other products that bear liquids which are likely to be exuded from the products. More particularly, the present invention relates to food storage containers incorporating a reservoir which contains absorbent material for collecting and absorbing excess liquids which exude from food, etc., in the form of biofluids, marinades, saline, juices, water, etc., so that the liquids and their associated microorganisms are held separate from the food while contained in the storage containers.

2. Description of the Related Art

Excess moisture within food storage containers can cause premature spoilage of food products which are stored in the containers because the moisture provides a favorable environment for the growth and reproduction of microorganisms. Excess moisture in a storage container also can lead to leakage of fluids from the storage container which can cause contamination of other foods and items about the container. Attempts at controlling excess moisture in food storage containers, such as trays (rigid and flexible) and bags, have met with some success. These prior art devices include: (1) pre-formed trays configured for the insertion of absorbent pads or absorbent sheets with the food products resting on the absorbent pad; (2) trays with built-in reservoirs arranged to trap excess moisture exuded from the products, with some of the trays including a cover which allows fluids to drain from the product into the reservoir but which partially restricts the fluids from reemerging past the cover following shaking or movement of the tray; and (3) trays or packs made from multiple layers of material with one layer being liquid impervious, the second layer being formed with perforations to allow fluids to enter, and an absorbent media sandwiched between the two layers to absorb and retain the entering fluids.

Several aspects of the prior art food containers with absorbent media limit the overall effectiveness of the containers and thereby fail to adequately address the need for absorbing excess liquids exuded from food products stored in containers. Particularly, a pad of absorbent material, typically formed of paper or a fluff-pulp structure, absorbs fluids but can not retain a great quantity of fluids when the pad is under pressure, such as when food is placed directly upon the pad or when food is placed on an upper layer of a tray which incorporates a pad sandwiched below the upper layer. In these configurations, the weight of the food upon the upper layer or directly on the absorbent pad compresses the pad and reduces the capacity of the pad to absorb liquids. Additionally, the amount of paper or fluff that would be required to produce a pad with sufficient absorbency to absorb and retain high levels of liquid is likely to require the pad to be too large for practical use. Furthermore, the prior art food storage trays usually have not incorporated reservoirs of a sufficient size to hold high levels of excess fluid without physically weakening the trays, thereby increasing the tendency of the trays to crack and leak fluids.

Therefore, there exists a need for devices and methods that address these and other shortcomings of the prior art.

SUMMARY OF THE INVENTION

Briefly stated, the present invention relates to storage containers for storing foods and other products that bear liquids which are likely to be exuded from the products. In a preferred embodiment, the storage container includes a base that defines an interior, and a lid that defines a reservoir. The lid is configured to engage the base so that food products placed within the interior may be retained therein. An absorbent material is arranged within the reservoir of the lid and is retained therein by a cover formed of liquid permeable material. The cover permits liquid exuded from the food products to enter the reservoir so that the absorbent material may absorb the liquid, such as when the storage container is inverted.

In some embodiments, the storage container includes a base defining an interior which is adapted to receive food products. Additionally, means for engaging the base and means for absorbing liquid exuded from the food products are provided.

Other embodiments of the present invention may be construed as providing methods for storing food products. In a preferred embodiment, the method includes the steps of: providing a storage container having a base and a lid, the base defining an interior; placing food products within the interior of the storage container when the base is oriented in a substantially upright configuration; engaging the base with the lid such that the food products are retained within the storage container; inverting the storage container such that the lid is disposed substantially beneath the base; and enabling liquid from the interior of the storage container to permeate into the lid such that the liquid is substantially removed from the interior and retained by the lid.

Other features and advantages of the present invention will become apparent upon reading the following specification, when taken in conjunction with the accompanying drawings.

BRIEF DESCRIPTION OF THE DRAWINGS

The accompanying drawings incorporated in and forming a part of the specification illustrate several aspects of the present inventions, and together with the description serve to explain the principles of the inventions. The components in the drawings are not necessarily to scale, emphasis instead being placed upon clearly illustrating principles of the present inventions.

DESCRIPTION OF THE PREFERRED EMBODIMENTS

Figure 1:
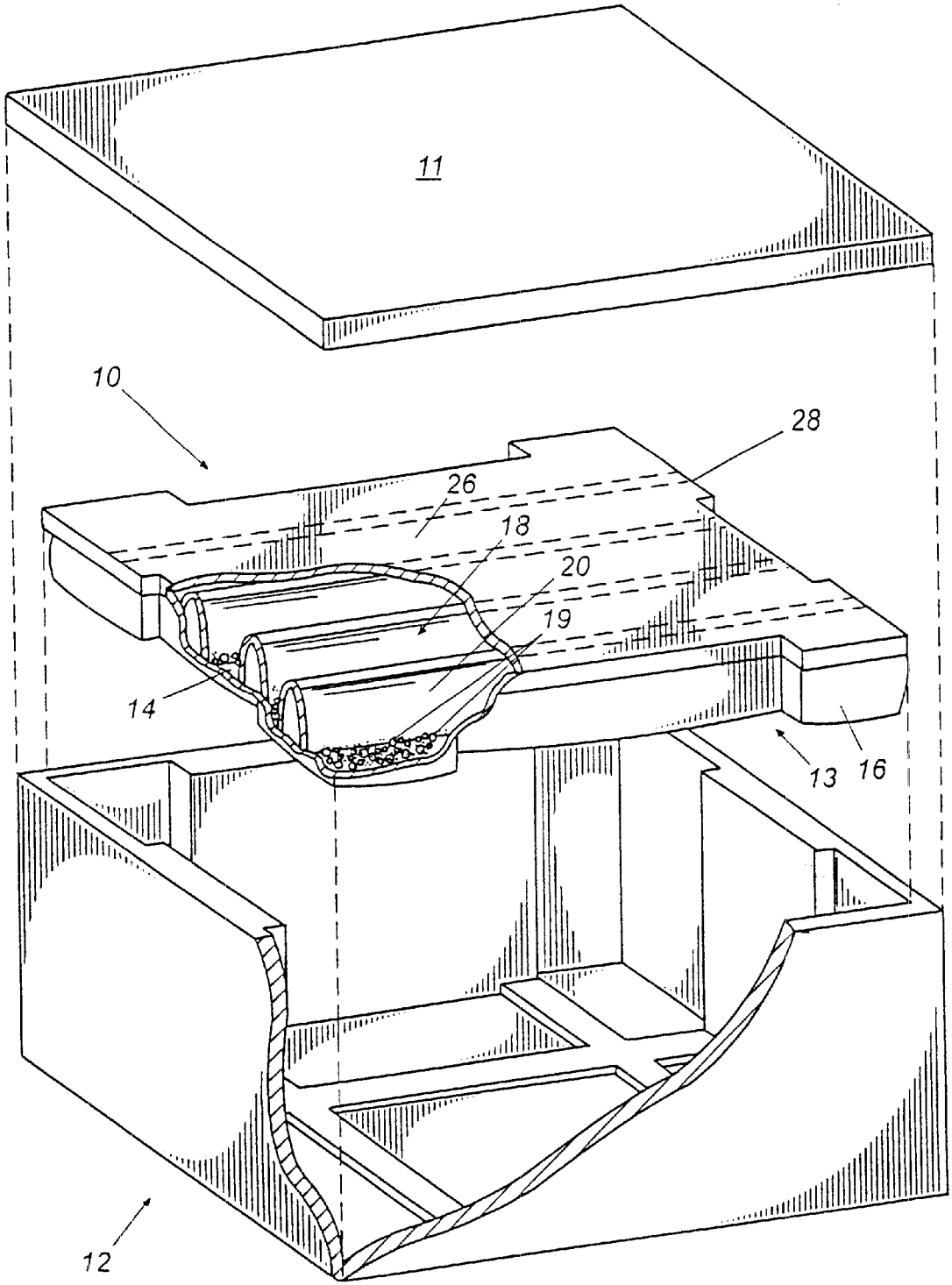
FIG. 1 is a partially cut-away, exploded perspective view of a preferred embodiment of the present invention incorporated into a representative storage container.

Referring now to the figures, wherein like reference numerals designate like parts throughout the several views, FIG. 1 depicts a preferred embodiment of the tray insert 10 of the present invention which is adapted to rest on the bottom of and conform to the interior of a storage container 12. The container 12 incorporates a lid 11 for sealing the container, however, it should be noted that the tray insert 10 is well suited for use in containers which do not incorporate lids, such as containers which are sealed by protective wraps and foils.

The tray insert 10 incorporates a tray portion 13 having a base 14 and side walls 16 which define a fluid collection and retention area or reservoir 18 for containing fluids which are leaked into the reservoir 18. The reservoir 18 also contains a quantity of super-absorbent material 19 which can take on various forms, such as particles, sheets, etc., with the material formed of cellulose derivatives, polymeric substances, clays or other suitable substances possessing sufficient absorbent characteristics.

The tray portion 13 can be formed of polystyrene, polypropylene, high density polyethylene, co-polyester or other similar materials, and can be thermally-formed, vacuum formed, etc., to produce a lightweight, shaped insert. In the preferred embodiment (FIG. 1), the tray insert 10 substantially conforms to the shape of the bottom portion of the interior of the storage container 12 in which the insert 10 is to be inserted. So configured, the storage container 12 housing the insert 10 provides strength and support to the insert 10 so that the insert 10 can adequately support the weight of the food products resting on the insert 10 and the weight of the fluid laden absorbent material 19 residing within the reservoir 18.

Figure 2:
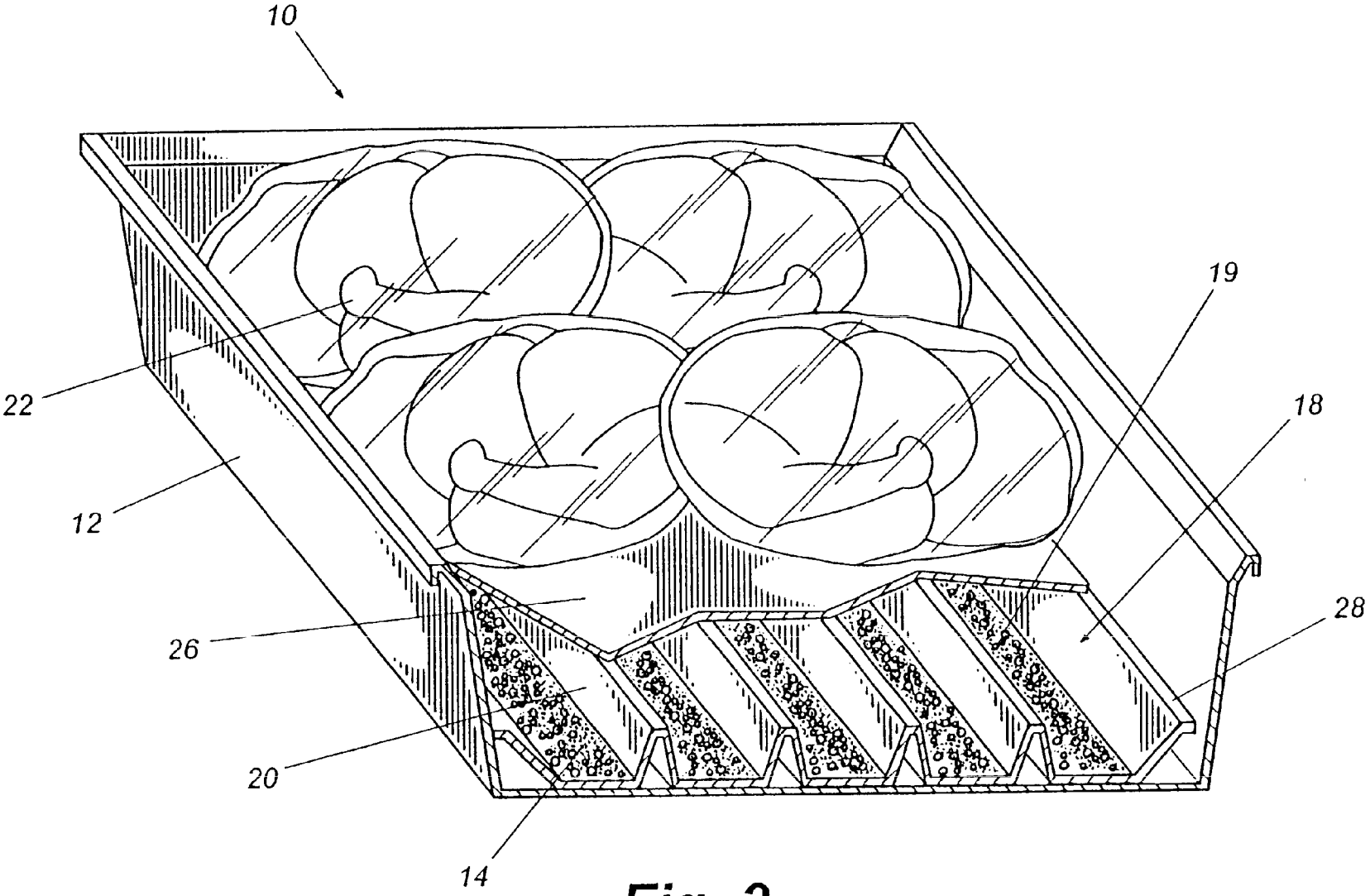
FIG. 2 is a cut-away perspective view of another embodiment of the present invention mounted within a storage container with representative food products placed upon the cover of the tray insert.

As shown in FIG. 1, the tray insert 10 incorporates one or more ribs 20 protruding from the base 14, and can be arranged in numerous configurations including parallel, diverging and interlacing, among others, depending upon the desired support characteristics required for a particular application. The ribs 20 serve as structural supports for food products 22 (shown in FIG. 2 as eviscerated poultry carcasses) which are placed in the storage container 12 above the absorbent tray insert 10 and which rest on the insert. The ribs 20 retain the products 22 above the bottom of the storage container 12 and the base 14 of the tray insert 10, thereby forming a space in which fluids (not shown) can accumulate and mix with the absorbent material 19 and in which expansion of the absorbent material 19 can occur without restriction.

Additionally, the ribs 20 provide structural support to the tray insert 10 such that the insert can be formed to quite a large size without the disadvantages of the prior art devices which are size limited due to a lack of incorporated structural support components. The ribs 20 also provide the benefit of preventing migration of the absorbent material 19 between the ribs 20, thereby substantially retaining the absorbent material 19 in a uniform distribution throughout the tray insert 10. Furthermore, rib segments (not shown in FIG. 1) also can be incorporated into the tray portion 13 which run normal to the main ribs 20, or in an orientation other than the orientation of the main ribs 20, thereby adding more support to the structure of the insert 10 and further limiting migration of the absorbent material 19 within the reservoir 18.

In the preferred embodiment of FIG. 1, a cover 26 formed of a liquid permeable sheet, is placed across the tray insert 10 to cover the reservoir 18. The cover 26 is preferably made of material such as perforated film, apertured film, non-woven fabric, non-woven laminated to apertured film, multi-composites or other suitable pervious material that can be bonded to the upper edge 28, for example, of insert 10, such as by heat sealing, applying an adhesive or by other suitable means, to create a barrier between the food products 22 placed on the cover 26 and the reservoir 18. In some embodiments, the cover 26 also can be bonded to the upper surfaces of the ribs 20 and rib segments for added structural support. As such, the cover 26 forms an additional support surface for the stored products 22 as the cover 26 spans the gaps formed between the raised ribs 20 to form a false bottom support surface in the bottom of the storage container 12. Therefore, the absorbent material 19 within the reservoir 18 and below the cover 26 is not compressed by the weight of the food products 22 placed on the cover 26, thereby allowing the absorbent material 19 to absorb and retain greater quantities of exuded fluid as compared to prior art devices Once products are placed upon the liquid permeable cover 26, any fluids exuded from the products 22 are able to flow through the cover 26 and into the reservoir 18 where interaction with the absorbent material 19 causes the fluids to be substantially retained within the tray insert 10 and away from the products 22. The cover 26 substantially retains the absorbent material 19 in the false bottom both before and after the fluid is absorbed by the absorbent material, thus preventing the fluid from recontaminating the stored food 22. After use, the tray insert 10 can be easily removed from the storage container 12 and conveniently disposed.

Additionally, in some embodiments, the tray insert 10 also can incorporate holes or fluid inlets (not shown) about the base 14 and side walls 16 of the tray portion 13 to allow fluids which seep between the insert 10 and the storage container 12 to enter the insert 10 and be absorbed by the absorbent material 19 within the reservoir 18. The addition of the fluid inlets also reduces the necessity for a seal to be formed between the upper edge 28 of the tray insert 10 and the interior side walls of the container 12 and provides an added means of fluid absorption when the seal existing between the insert 10 and the storage container 12 is disturbed, such as when the storage container 12 is slightly deformed or damaged during shipping. It should be noted, however, that the size and arrangement of the fluid inlets should be such that the absorbent material 19 is substantially retained within the reservoir 18.

Figure 3:
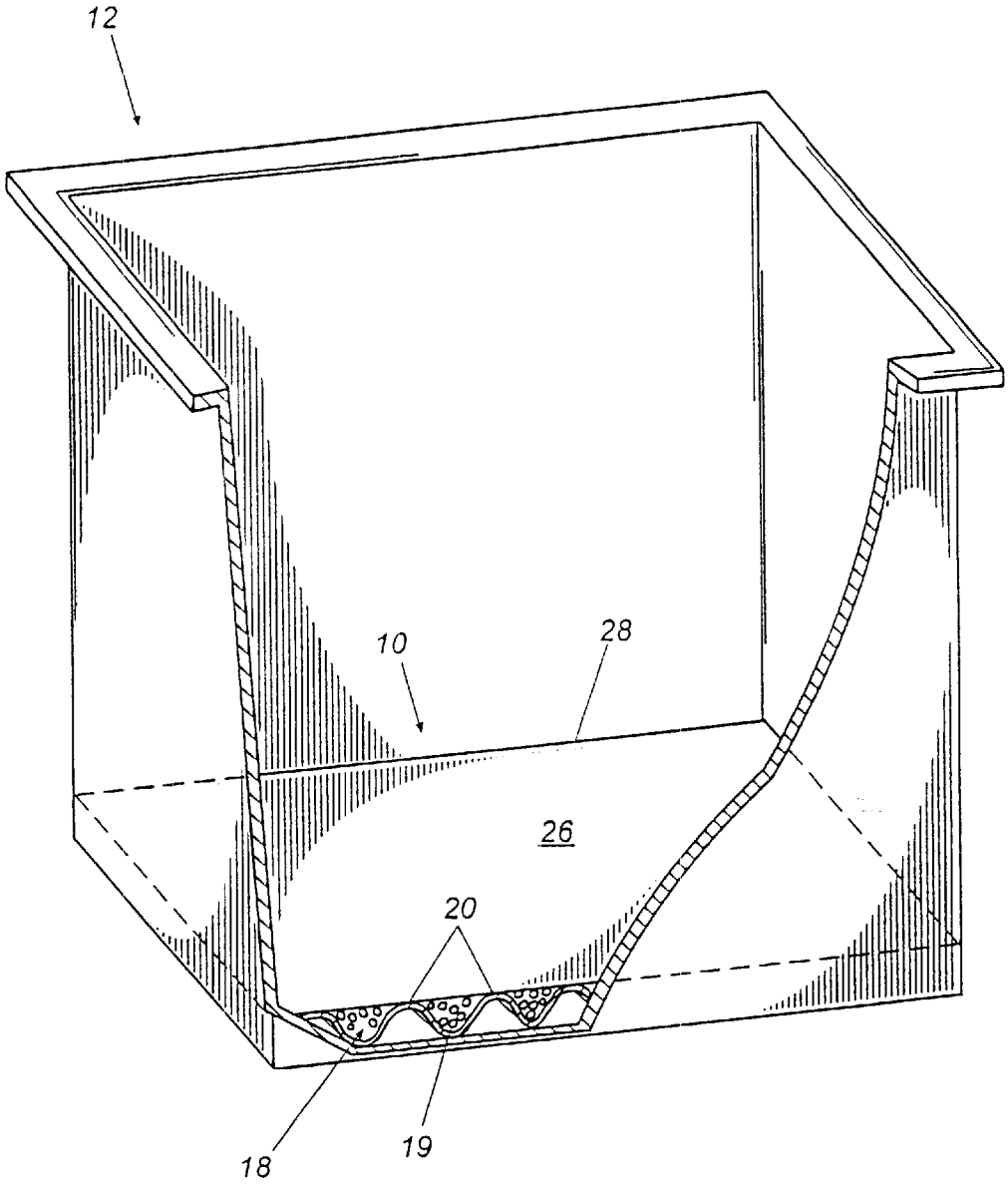
FIG. 3 is a partially cut-away, perspective view of an alternative embodiment of the present invention.

In some embodiments, the tray insert 10 can be integrated with a disposable storage container 12 to form a unitary structure as shown in FIG. 3. In this disposable-container configuration, the container 12 is adapted for one-time use, after which the entire insert-container combination is discarded. In other disposable-container embodiments (not shown), the tray insert 10 mates with a container 12, such as by forcing the insert 10 into the bottom of the container 12 until the upper edge 28 of the insert 10 passes a rib, flange or other protruding structure or structures (not shown), which are formed on the interior of the side wall of the container 12, thereby locking the insert 10 in place between the protruding structures and the bottom of the container 12.

When an insert 10 has been incorporated into a reusable storage container 12, i.e. FIG. 1, and the container has been used for transporting and/or storing food products, and the food products have been removed from the container for use, the insert 10 can then be removed and discarded. The storage container 12 can then be cleaned and reused by inserting a new tray insert 10 within the container and reloading the container with food products 22. Likewise, when the insert 10 has been incorporated into a disposable storage container 12, i.e. FIG. 3, and the container has been used for transporting and/or storing food products, and the food products have been removed from the container for use, the combination container and insert can be discarded without removing the insert 10.

In other embodiments (FIG. 4), a disposable storage container 12 can be formed which incorporates structural ribs 20 and rib segments 25 similar to those found in a tray insert 10 described hereinabove, with the ribs 20 and 25 being formed as a part of the base 14 of the container. A perimeter rib 29 also can be incorporated which extends inwardly from the side wall 16 and into the reservoir 18 and which can cooperate with the ribs 20 and 25 to form a series of cells 30. The cells 30 formed between the ribs 20, 25 and 29 are then filled with absorbent material 19. A cover 26 is placed across the top of the ribs and sealed to the ribs, and also, in some embodiments, to the side wall 16, so that a barrier is formed for containing the absorbent material 19 within the cells 30.

The ribs 20, optional rib segments 25 and optional perimeter rib 29 can be formed in multiple configurations so that they structurally support the container 12, support the liquid permeable cover 26 and products 22 placed thereon, and divide the reservoir 18 so that the absorbent material 19 is distributed throughout the reservoir as desired, i.e. uniformly, concentrated in the center, etc.

Figure 4:
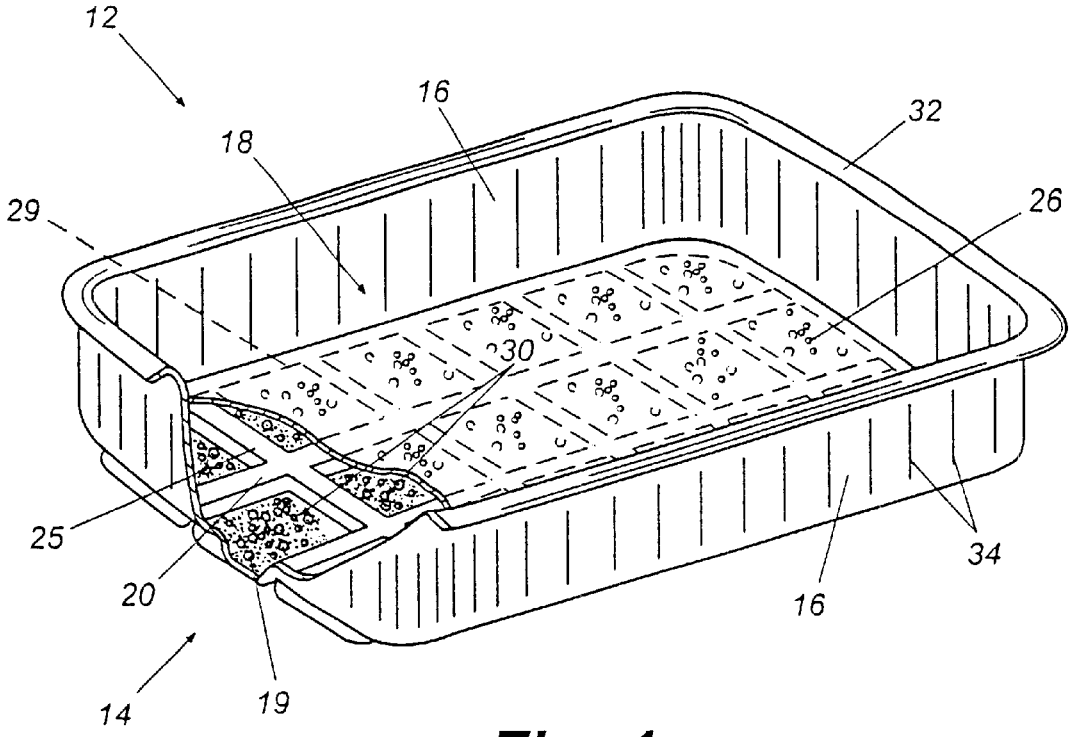
FIG. 4 is a partially cut-away, perspective view of an alternative embodiment of the present invention.

As shown in FIG. 4, an upper rim or flange can extend from the upper edge of the side wall 16 to provide a surface upon which a lid or covering (not shown) can be attached. The side wall 16 also can incorporate a series of vertical ribs 34 which reinforce the side wall 16 and provide a textured surface for ease of grasping the container 12.

Figure 5:
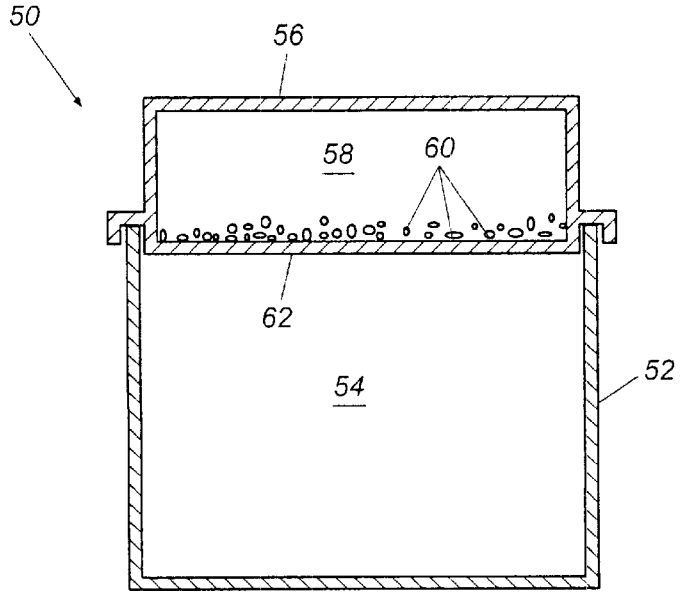
FIG. 5 is a schematic view of an alternative embodiment of the present invention.

Referring now to FIGS. 5–9, alternative embodiments of the storage container of the present invention will be described. As shown in FIG. 5, container 50 includes a base 52 which defines an interior 54 that is adapted for storing food products therein. A lid 56 also is provided that is adapted to engage the open end of the base 52 so as to suitably seal the interior 54, e.g., engagement of the lid 56 with the base 52 substantially prevents food products and/or their associated liquids from leaking from the interior. Lid 56 includes a reservoir 58 that is adapted to contain liquid absorbent material, which can take on various forms, such as particles, sheets, etc., with the material being formed of cellulose derivatives, polymeric substances, clays and/or other suitable substances possessing sufficient absorbent characteristics. Preferably, liquid absorbent material 60 is "food safe," i.e., the liquid absorbent material includes materials and/or ingredients defined by the Food and Drug Administration (FDA) as being generally regarded as safe (GRAS) for direct food contact, and may contain antimicrobial additives and/or substances, such as citric acid, for example.

Liquid absorbent material 60 is retained in reservoir 58 by a membrane or cover 62 that engages the lid. Although preventing the absorbent material from leaving the reservoir, cover 62 is adapted to permit liquids from the interior 54, such as liquids exuded from food products, to pass therethrough and into the reservoir. For example, such a cover may be formed of non-woven liquid permeable material, among others.

As liquid may be retained by the absorbent material of the reservoir and, therefore, may present an unappealing or unappetizing appearance, the lid may be formed of a substantially opaque material, such as a dark colored plastic, for example, which is intended to reduce visibility of substances contained in the reservoir. Additionally, in some embodiments, the base may be formed of a clear material, such as a transparent plastic, for example, to facilitate ready identification of food products stored within the interior of the base. Various other color configurations may be utilized as well.

Figure 6:
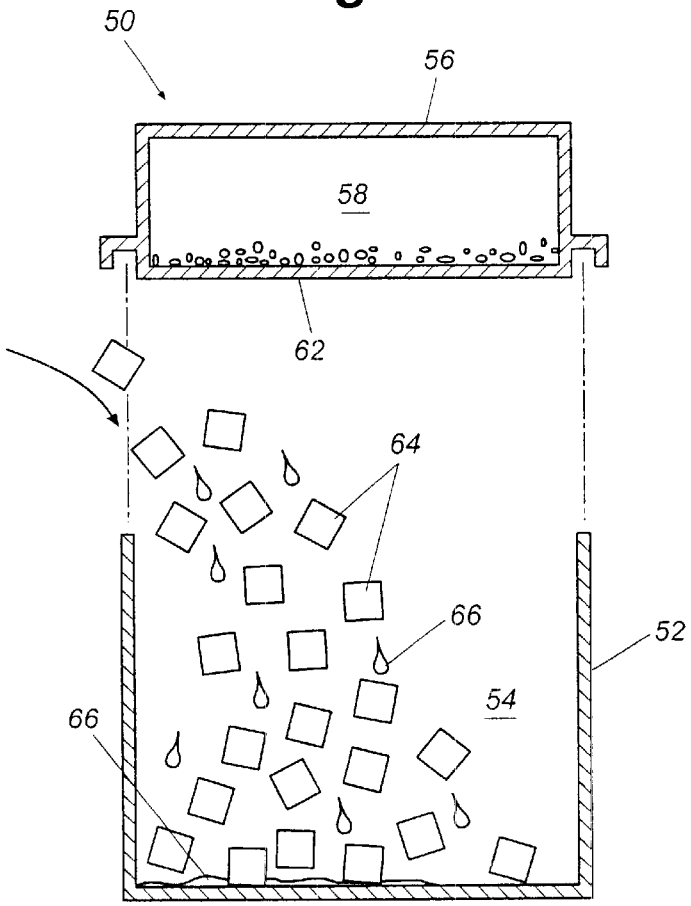
FIG. 6 is a schematic view of the embodiment depicted in FIG. 5.
Figure 7:
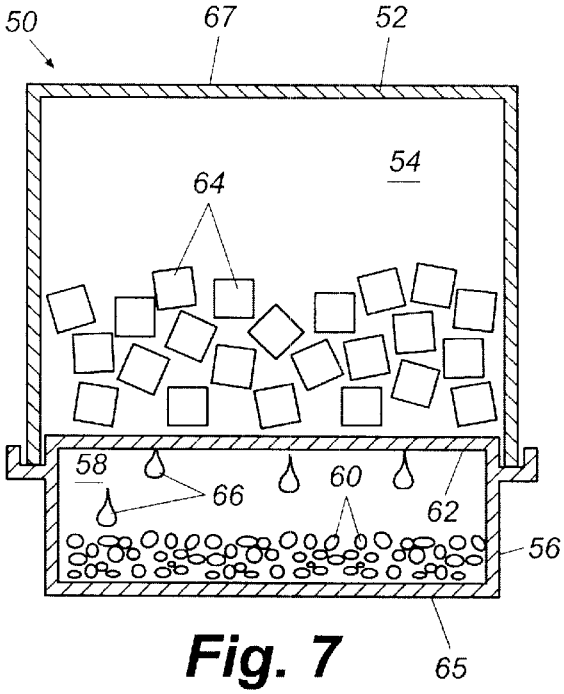
FIG. 7 is a schematic view of the embodiment depicted in FIGS. 5 and 6.
Figure 7A:
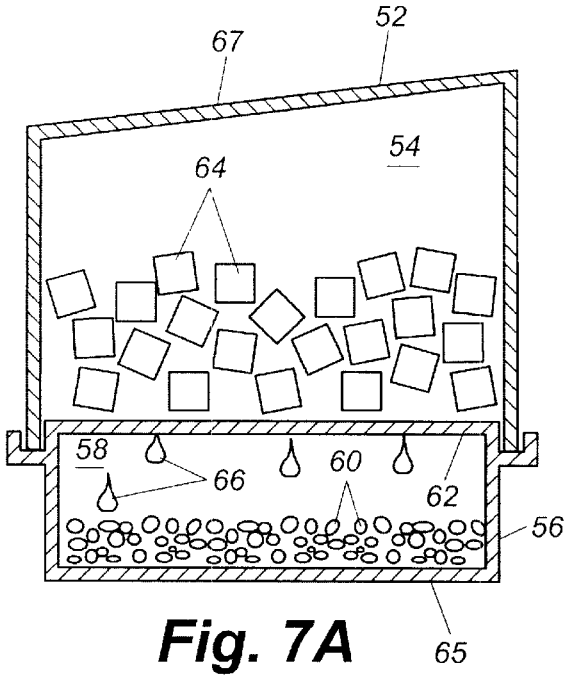
FIG. 7A is a view, similar to FIG. 7, but illustrating the lid and base being sloped with respect to each other.

As depicted in FIG. 6, interior 54 of container 50 may be filled with products which tend to exude and/or tend to be associated with liquids. Representative food products 64 and accompanying liquid 66 are depicted schematically in FIG. 6. After the food products 64 and liquid 66 have been appropriately provided to the container interior 54, lid 56 engages base 52, thereby sealing the products 64 and accompanying liquid 66 within the interior 54. Thereafter, such as depicted in FIG. 7, the entire container 50 may be inverted, e.g., the base is arranged substantially above the lid. So provided, much of the liquid 66, which was previously contained within interior 54, is able to permeate through cover 62 and be absorbed by the absorbent material 60 contained within the lid 56. Thus, products 64 contained within the interior 54 are exposed to a reduced liquid content of the interior 54, thereby potentially improving the shelf life of the food products.

The container 50 may be retained in its inverted position during storage, shipping, and product display, for example. Thus, in some embodiments, the upper surface 65 of the lid is configured to facilitate stable placement of the container in the inverted position, e.g., the upper surface may be provided in a configuration suited for engaging a flat tabletop surface, for instance. Inverted positioning of the container also exposes the bottom surface 67 of the base to view, thereby rendering the bottom surface an appropriate location for the placement of indicia, such as product labeling, for example. In some embodiments, the upper surface of the lid may be inclined relative to the base, thereby tending to tilt the bottom surface toward a viewer when in the inverted position.

While oriented in the inverted position, such as depicted in FIG. 7, food products 64 typically rest upon and are supported by cover 62. Therefore, cover 62 should be formed of a material possessing suitable strength for supporting food products thereon. In order to increase the degree of structural support provided by the cover 62, ribs (not shown) and/or other supporting structures, such as disclosed in relation to the embodiments depicted in FIGS. 3 and 4, also may be provided.

Figure 8:
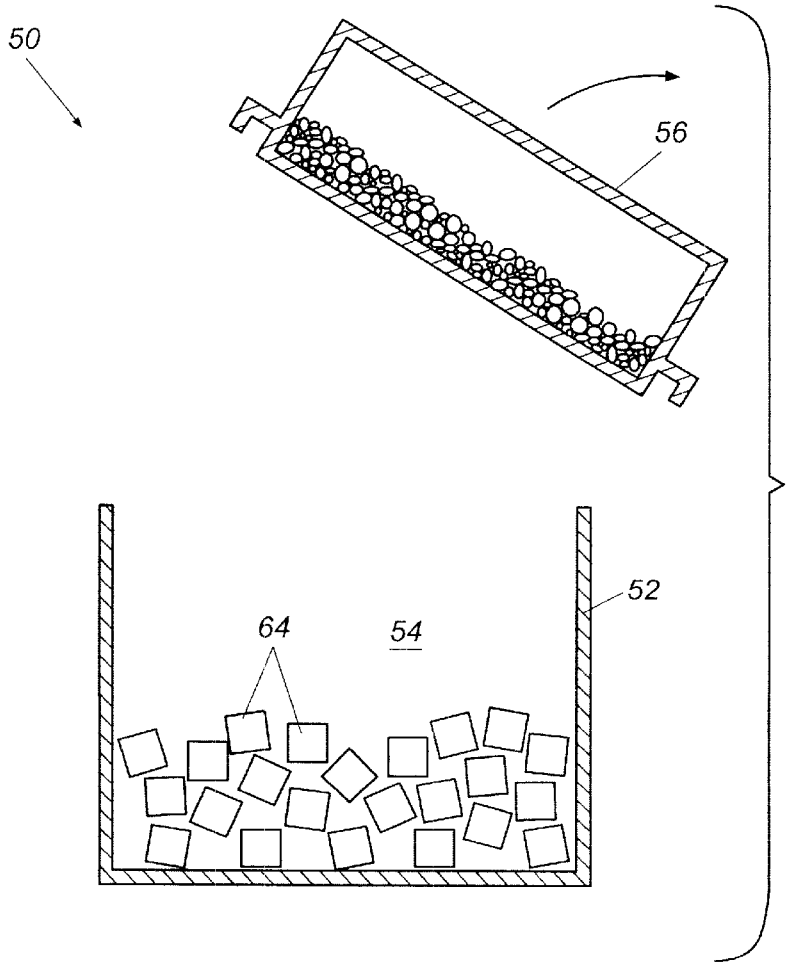
FIG. 8 is a schematic view of the embodiment depicted in FIGS. 5–7.

The food products may be accessed by removing lid 56 (depicted in FIG. 8). The lid, which now contains absorbent material 60 as well as any absorbed liquids, may be conveniently discarded. Thus, the present invention provides storage containers and associated methodologies that are adapted to efficiently remove excess liquids from stored food products, thereby potentially increasing the shelf life of the stored food products.

It should be noted that various sizes, shapes and configurations of storage containers may implement the teachings of the present invention. For instance, multiple sizes of bases, i.e., bases possessing different interior storage volumes, may be constructed that are adapted to be engaged by a common lid. Additionally, bases may be formed that are adapted to seat within an automobile cup-holder, for example.

Figure 9:
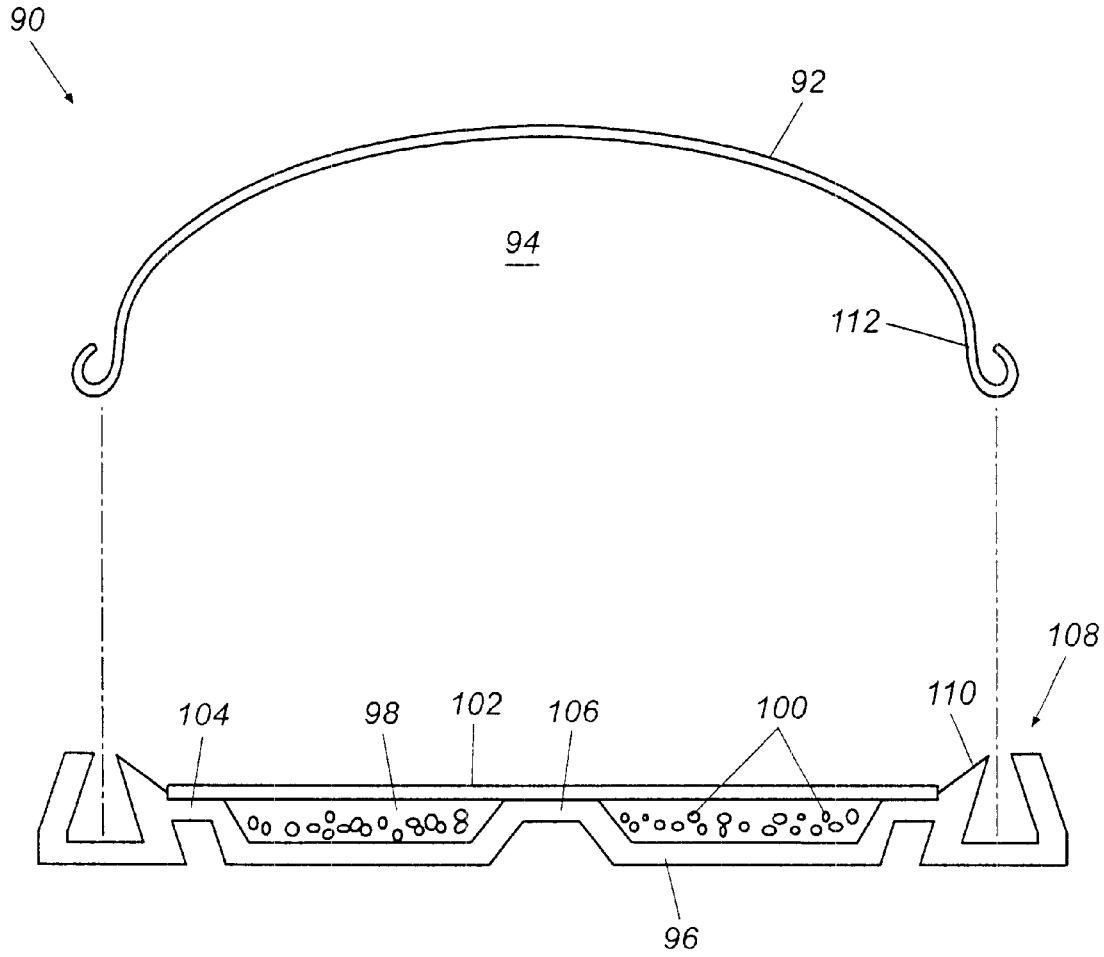
FIG. 9 is a schematic view of an alternative embodiment of the present invention.

Referring now to FIG. 9, an alternative embodiment 90 of the container will be described. As shown in FIG. 9, container 90 includes a base 92, which defines an interior 94, that is adapted for storing food products therein. A lid 96 also is provided which is adapted to engage the open end of the base 92 so as to suitably seal the interior 94. Lid 96 includes a reservoir 98 that is adapted to contain absorbent material 100. Much like the embodiment depicted in FIGS. 5–8, the liquid absorbing material 100 is retained in reservoir 98 by a cover 102 that is adapted to permit liquids exuded from food products stored within interior 94 to penetrate therethrough and into the reservoir 98.

As depicted in FIG. 9, the container 90 may be inverted so that food products within the container are supported by the lid. More specifically, the food products may be supported by the cover 102, which is sealed to the lid, such as along a flanged portion 104 and/or one or more raised portions 106. So configured, sufficient structural support may be provided for displaying food products, such as poultry, for example. Thus, the lid may be utilized as a hybrid tray-lid, so that, when the storage container is in an upright orientation, the lid performs the conventional function of sealing the food products within the container interior and, when the storage container is inverted, the lid provides the additional function of serving as a liquid-retaining reservoir as well as a tray-like support structure.

In order to promote effective liquid collection by the reservoir 98, base 92 and lid 96 cooperate so as to direct liquids from the interior through the cover and into the reservoir. In particular, closure rim 108 of the lid, which is adapted to engage base 92, includes a tapered inner surface 110. Inner surface 110 is adapted to direct liquid from the inner surface 112 of the base inwardly toward the cover and reservoir, thereby reducing the possibility of liquid leaking from the interior of the storage container.

In other embodiments, promotion of effective liquid collection by a container reservoir may be facilitated by the inner surface of the base being adapted to engage a portion of the cover at locations other than the outer periphery of the cover. So configured, liquid residing on the inner surface of the base may run along the inner surface, contact the cover, and then drain into the reservoir.

The foregoing description has been presented for purposes of illustration and description. It is not intended to be exhaustive or to limit the invention to the precise forms disclosed. Modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A storage container for containing and preserving food products that exude liquid comprising:

a transparent base defining an interior;

a lid configured to engage said base such that food products placed within said interior are retained therein;

a cover formed of liquid permeable material engaging said lid and forming a reservoir with said lid;

absorbent material for absorbing liquid arranged within said reservoir of said lid; and said cover being configured to retain said absorbent material within said reservoir and food products out of sid reservoir when said storage container is inverted;

such that when the container is inverted liquid exuded from the food products permeates downwardly through said cover, enters sid reservoir of said lid, and is absorbed by said absorbent material and the food product is visually exposed through the transparent base.

2. The storage container of claim 1, wherein said cover is configured to support the food products placed within said interior when said storage container is inverted.

3. The storage of claim 1, wherein said liquid permeable material is a non-woven sheet material.

4. The storage container of claim 1, wherein said absorbent material comprises absorbent particles.

5. The storage container of claim 1, wherein said absorbent material comprises an absorbent pad.

6. The storage container of claim 1, wherein said lid has a flange, said flange extending inwardly toward said reservoir, said flange engaging at least a portion of said cover such that said cover securely engages said lid.

7. The storage container of claim 1, wherein said base is configured to engage an automobile cup-holder.

8. The storage container of claim 1, wherein said lid is inclined relative to said base.

9. The storage container of claim 1, further comprising food products placed within said interior and sealed therein such that liquids exuded from said food products are retained within said container.

10. A storage container for containing and preserving food products that exude liquid comprising:

a transparent base defining an interior, said interior being configured to receive food products;

lid means for engaging said transparent base such that food products placed within said interior are retained therein; and said lid means including means for absorbing liquid exuded from the food products when said storage container is inverted;

so that the food product is visible through the transparent base when said storage container is inverted and to facilitate identification of the food products contained within the interior of the transparent base.

11. The storage container of claim 10, further comprising means for supporting the food products placed within said interior when said storage container is inverted.

12. The storage container of claim 11, wherein means for engaging said base and supporting food products is a non-woven sheet material.

13. The storage container of claim 10, wherein said means for absorbing liquid exuded from the food products when said base is inverted comprises absorbent particles.

14. The storage container of claim 10, wherein said means for absorbing liquid exuded from the food products when said base is inverted comprises an absorbent pad.

15. The storage container of claim 10, further comprising food products placed within said interior and sealed therein such that liquids exuded from said food products are retained within said container.

16. A method for storing food products that exude liquid comprising the steps of:

providing a storage container having a base and a lid, the base defining an interior;

providing a liquid absorbent material within said lid;

placing food products within the interior of the storage container;

engaging the base with the lid such that the food products are retained within the storage container;

inverting the storage container such that the lid is disposed substantially beneath the base; and enabling liquid exuded from food products within the interior of the storage container to permeate into the lid;

absorbing liquid permeated into the lid with the liquid absorbent material;

such that the liquid exuded from the food products is substantially removed from the food products and retained by the lid.

17. The method of claim 16, further comprising the steps of:

removing the lid form the base; and discarding the lid and the liquid retained therein.

18. The method of claim 16, wherein the step of placing comprises the step of:

placing food products within the interior of the storage container when the base is oriented in a substantially upright configuration.

19. The method of claim 16, wherein the step of providing a liquid absorbent material within said lid comprises the steps of:

providing a cover of liquid permeable material; and disposing the absorbent material between the cover and the lid such that the cover is arranged adjacent to the interior of the base when the lid engages the base.

* * * * *